United States Patent [19]

Yamada

[11] Patent Number: 5,013,999

[45] Date of Patent: May 7, 1991

[54] VOLTAGE GENERATING CIRCUIT USING A SCHOTTKY BARRIER DIODE

[75] Inventor: Kazuyoshi Yamada, Tokyo, Japan

[73] Assignee: NEC Corporation, Japan

[21] Appl. No.: 463,423

[22] Filed: Jan. 11, 1990

[30] Foreign Application Priority Data

Jan. 20, 1989 [JP] Japan ..... 1-11323

[51] Int. Cl.[5] ..... G05F 3/22

[52] U.S. Cl. ..... 323/313; 307/317.2; 307/458; 323/907

[58] Field of Search ..... 323/313, 907; 307/317 A, 296.7, 458

[56] References Cited

U.S. PATENT DOCUMENTS 4,037,115 7/1977 Lee ..... 307/458
4,400,635 8/1983 Mazgy ..... 307/458
4,542,331 9/1985 Boyer ..... 323/313
4,956,567 9/1990 Hunley et al. ..... 323/907

*Primary Examiner*—William H. Beha, Jr.
*Attorney, Agent, or Firm*—Laff, Whitesel, Conte & Saret

[57] ABSTRACT

A temperature-compensated voltage generating circuit suited for an output stage of a logical circuit is provided. The voltage generating circuit includes a bipolar transistor, a first resistor connected between the collector and the base of the bipolar transistor and a series circuit including a second resistor and a Schottky barrier diode and connected between the base and the emitter of the bipolar transistor. The temperature dependency of the base-emitter forward voltage of the bipolar transistor is offset by the temperature dependency of the forward voltage of the Schottky barrier diode by having the ratio of the resistances of the first and second resistors set based on a predetermined formula.

4 Claims, 2 Drawing Sheets

VOLTAGE GENERATING CIRCUIT USING A SCHOTTKY BARRIER DIODE

BACKGROUND OF THE INVENTION

The present invention relates to a voltage generating circuit in a semiconductor integrated circuit and, more particularly, to a voltage generating circuit in which an output voltage is temperature-compensated and which is operable over high frequencies such a 100 MHz.

In conventional voltage generating circuits, since the output voltage of a logical output circuit is determined by the forward voltages of such elements as diodes and transistors, the circuits are so constructed as to have negative temperature dependencies. Therefore, such conventional voltage generating circuits have a problem in that there is a high possibility of the occurrence of the collector saturation in a transistor of the output circuit, especially at a high temperature.

SUMMARY OF THE INVENTION

It is an object of the present invention to provide an improved voltage generating circuit for use in a semiconductor integrated circuit.

It is another object of the present invention to provide a voltage generating circuit in which an output voltage therefrom is effectively temperature-compensated.

According to the present invention, there is provided a voltage generating circuit comprising;

a bipolar transistor having a collector, a base an an emitter;

a first resistor connected between the collector and the base of the bipolar transistor; and a series circuit, composed of a second resistor and a Schottky barrier diode, connected between the base and the emitter of the bipolar transistor.

BRIEF DESCRIPTION OF THE DRAWINGS

The above and other objects, features and advantages of the present invention will be apparent from the following description of preferred embodiments of the invention with reference to the accompanying drawings, in which.

PREFERRED EMBODIMENTS OF THE INVENTION

Throughout the following description, similar reference symbols or numerals refer to similar elements in all Figures of the drawings.

For the purpose of understanding of the present invention, some examples of the prior art will first be described before the explanation of the present invention.

Figure 1:
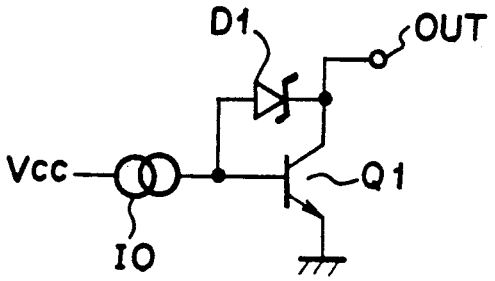
FIG.1 PRIOR ART
FIG. 1 shows a conventional voltage generating circuit for use in a conventional logical circuit.

FIG. 1 shows a schematic circuit diagram of an example of a conventional output stage for use in a logical circuit.

As shown in FIG. 1, a voltage generating circuit constituting a logical output stage for setting an output voltage value includes a Schottky barrier diode (hereinafter referred to as "SBD") connected between the collector and the base of a bipolar transistor (hereinafter referred to as "transistor") Q1. The circuit as described above is most commonly used for the output stage of the conventional logical circuit.

An output voltage value $V_{OL}$ at an output terminal OUT of the above voltage generating circuit is determined depending on the difference between the base-emitter forward voltage $V_F$ of the transistor Q1 and the forward voltage $V_S$ of the SBD D1, which is expressed by the following equation:

$$V_{OL}=V_F-V_S \tag{1}$$

That is, the forward voltage $V_S$ of the SBD D1 is used as a clamp voltage generating source, which suppresses the collector saturation to be caused by the excessive lowering of the collector voltage of the transistor Q1. In such an example circuit, the temperature dependency of the output voltage $V_{OL}$ may be determined based on the Equation (1) as follows:

$$\frac{\partial V_{OL}}{\partial T}=\frac{\partial V_F}{\partial T}-\frac{\partial V_S}{\partial T} \tag{2}$$

On the other hand, $$\frac{\partial V_F}{\partial T}\approx\frac{V_F-V_G}{T},\ \frac{\partial V_S}{\partial T}\approx\frac{V_S-V_{GS}}{T} \tag{3}$$

where $V_G$ is an energy difference (band gap or energy gap) between the filled band and the conduction band in the bipolar transistor, $V_{GS}$ is a difference in work function between the metal and the semiconductor material forming the SBD, and T is a junction temperature of the active element therein.

Thus, the following Equation (4) is obtained from the above Equations (2) and (3):

$$\frac{\partial V_{OL}}{\partial T}=\frac{(V_F-V_S)-(V_G-V_{GS})}{T} \tag{4}$$

Assuming that the representative values are taken as $V_F=0.8V$, $V_S=0.5V$, $V_G=1.2V$, $V_{GS}=0.7V$ and $T=300°$ K., the Equation (4) results in $$\frac{\partial V_{OL}}{\partial T}\approx -0.7\ [\mathrm{mV/deg}] \tag{5}$$

That is, from the Equation (5), it is known that the output voltage $V_{OL}$ has a temperature dependency of $-0.7$ mV/deg.

Figure 2:
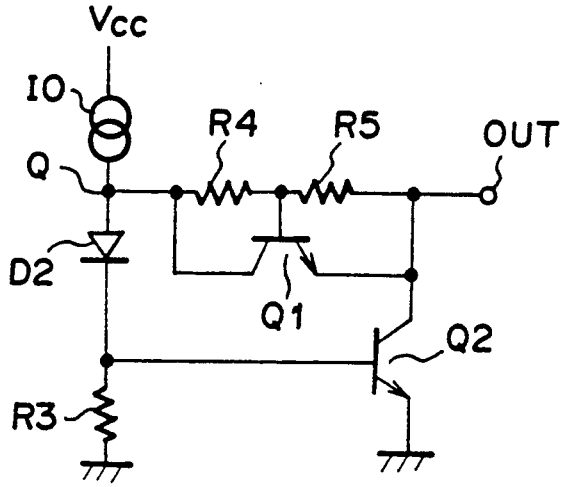
FIG.2 PRIOR ART
FIG. 2 shows another example of a conventional voltage generating circuit for use in a logical circuit.

FIG. 2 is a circuit diagram of another example of a conventional output stage in a logical circuit.

As shown in FIG. 2, the output stage circuit here is of an example of output circuit in which, unlike the one shown by FIG. 1, no SBD is used to simplify the fabrication process. In this circuit, the potential difference across a voltage generating circuit constituted by resistors R4, R5 and the transistor Q1, the potential drop across a diode D2 and the potential between the base and the emitter of a transistor Q2 are combined to prevent an unwanted drop in the collector voltage of the transistor Q2.

That is, a potential difference $V_{CE}$ produced between the collector and the emitter of the transistor Q1 is obtained by the following Equation (6):

$$V_{CE} = \left(1 + \frac{R4}{R5}\right)V_F \tag{6}$$

wherein $V_F$ is a base-emitter forward voltage of the transistor Q1.

On the other hand, since the voltage developed at the point Q by the diode D2 and the transistor Q2 is $2V_F$, an output voltage $V_{OL}$ at the output terminal OUT following the Equation (6) is $$V_{OL} = 2V_F - V_{CE} = \left(1 - \frac{R4}{R5}\right)V_F \tag{7}$$

Thus, when the representative values are assumed as $V_{OL}=0.3V$, $V_F=0.8V$, the resistance ratio R4/R5 obtained by the Equation (7) will be 0.625.

Under the above state, following the Equations (2), (3) and (7), the temperature dependency of the output voltage $V_{OL}$, on the assumption that the value of the resistance ratio R4/R5 in the Equation (7) is constant with respect to temperature, can be expressed as:

$$\frac{\partial V_{OL}}{\partial T} = \left(1 - \frac{R4}{R5}\right)\frac{\partial V_F}{\partial T} \approx \left(1 - \frac{R4}{R5}\right) \times \frac{V_F - V_G}{T} \tag{8}$$

Therefore, substituting R4/R5=0.625, $V_F=0.8V$, $V_G=1.2V$, T=300° K. into the Equation (8) results in $$\partial V_{OL}/\partial T \approx -0.5[mV/\text{deg}] \tag{9}$$

That is, the output voltage $V_{OL}$ has a temperature dependenc of −0.5mV/deg.

Figure 3:
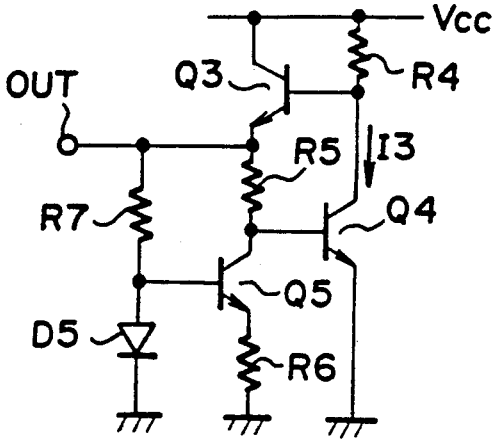
FIG.3 PRIOR ART
FIG. 3 shows a further example of a conventional volt age generating circuit for use in a logical circuit.

FIG. 3 shows a further example of a conventional voltage generating circuit.

The voltage generating circuit as shown in FIG. 3 is one used in an ordinary power supply circuit of which the output voltage may be several hundreds mV. The circuit of FIG. 3 is used in a voltage source such as a so-called band gap voltage source in which an output voltage $V_{OL}$ taken from the emitter side (OUT) of a transistor Q3 is substantially the same order as the band gap voltage $V_G$.

In detail, an output voltage $V_{OL}$ is stabilized by having a voltage applied to the base of a control transistor Q4 through a resistor R5 thereby to effect a reverse feedback to the variations of $V_{OL}$. Since the base-emitter forward voltage $V_F$ of a bipolar transistor has a negative temperature dependency of −1.5 to −2mV/deg with respect to temperature variations, when a voltage applied to the base of the transistor Q4 through the resistor R5 is constant, a collector current I3 of the transistor Q4 increases exponentially as the temperature increases. Thus, it is required that the collector current I3 of the transistor Q4 be made stable against the temperature variations by making the voltage applied to the base of the transistor Q4 so as to have a temperature dependency of +1.5 to +2mV/deg. In the circuit as shown in FIG. 3, the temperature dependency of the forward voltage difference to take place between a diode D5 and the transistor Q5 is of a positive value and the temperature dependency of the base-emitter forward voltage of the transistor Q4 is of a negative value, so that the temperature dependency of the output voltage $V_{OL}$ is made zero by the offsetting of the positive value and the negative value.

In the conventional voltage generating circuits as explained above, the output voltage $V_{OL}$ of the logical output circuit is determined by the forward voltage $V_S$ of the diode and the base-emitter forward voltage $V_F$ of the transistor and the circuits are so arranged as to have a negative temperature dependency therein. Therefore, in such conventional voltage generating circuits, there is a high possibility of the occurrence of the collector saturation in the output circuit transistor especially at a region of high temperature.

The present invention provides an improved voltage generating circuit in which the temperature compensation is effected so as to suppress the collector saturation in the transistor of the output circuit.

The preferred embodiments of the present invention are hereinafter explained with reference to the drawings.

Figure 4:
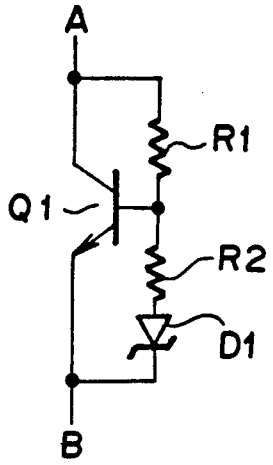
FIG. 4 shows a fundamental circuit diagram for explaining the embodiments of the present invention.

FIG. 4 shows a schematic diagram illustrating a fundamental voltage generating circuit of the present invention.

As shown in FIG. 4, the fundamental voltage generating circuit comprises a bipolar transistor Q1, a first resistor R1 connected between the base and the collector of the transistor Q1 and a series circuit, composed of a second resistor R2 and a Schottky barrier diode D1, connected between the base and the emitter of the transistor Q1. In this voltage generating circuit, where a current flowing from a point A into the circuit is sufficient to activate the same, the potential difference $V_{AB}$ appearing between the point A and point B is expressed by the following Equation (10):

$$V_{AB} = \left(1 + \frac{R1}{R2}\right)V_F - \frac{R1}{R2}V_S \tag{10}$$

Where $V_F$ is the base-emitter forward voltage of the transistor Q1 and $V_S$ is the forward voltage of the SBD D1.

Figure 5:
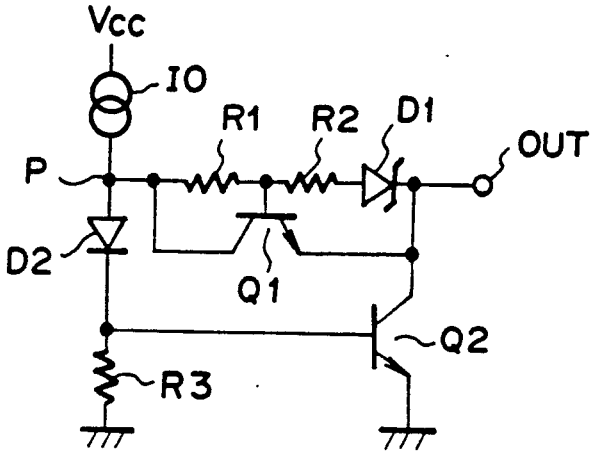
FIG. 5 shows a voltage generating circuit according to an embodiment of the present invention.

FIG. 5 shows a voltage generating circuit of a first embodiment of the present invention.

As shown in FIG. 5, the invention is applied to an output stage of a logical circuit similar to the FIG. 2 circuit and, in addition to the fundamental circuit shown in FIG. 4, the circuit of this embodiment includes a bipolar transistor Q2, a PN junction diode D2, a resistor R3 and a constant-current source IO.

In the voltage generating circuit of this embodiment, the voltage at a point P is equal to the sum of the base-emitter forward voltage of the transistor Q2 and the forward voltage of the diode D2 and, therefore, will be $2V_F$. Thus, following the above Equation (10), the output voltage $V_{OL}$ at the output terminal OUT will be expressed by the following Equation (11):

$$V_{OL} = 2V_F - \left(1 + \frac{R1}{R2}\right)V_F + \frac{R1}{R2}V_S = \left(1 - \frac{R1}{R2}\right)V_F + \frac{R1}{R2}V_S \quad (11)$$

By partially differentiating the Equation (11) with respect to temperature T, the temperature dependency of the output voltage $V_{OL}$ can be expressed as:

$$\frac{\partial V_{OL}}{\partial T} = \left(1 - \frac{R1}{R2}\right)\frac{\partial V_F}{\partial T} + \frac{R1}{R2} \times \frac{\partial V_S}{\partial T} \quad (12)$$

The Equation (12) may be modified by substituting the relation of the Equation (3) as follows:

$$\frac{\partial V_{OL}}{\partial T} = \left(1 - \frac{R1}{R2}\right) \times \frac{V_F - V_G}{T} + \frac{R1}{R2} \times \frac{V_S - V_{GS}}{T} \quad (13)$$

By way of example, generally known parameters as $V_F=0.8V$, $V_G=1.2V$, $V_S=0.52V$, $V_{GS}=0.7V$ and $T=300°$ K. may be substituted into the Equation (13). If, order to eliminate the temperature dependency, the relation of $\partial V_{OL}/\partial T=0$ is established, the Equation (14) is obtained as:

$$\frac{\partial V_{OL}}{\partial T} \approx 1.3 \times \left(\frac{R1}{R2} - 1\right) - 0.6 \times \frac{R1}{R2} = 0 \text{ [mV/deg]} \quad (14)$$

Therefore, the resistance ratio between the resistors R1 and R2 will be obtained based on the above Equation (14) as follows:

$$\frac{R1}{R2} \approx 1.86 \quad (15)$$

Thus, it is understood from the above that, in order to prevent the collector saturation in the transistor Q2, no temperature dependency $\partial V_{OL}/\partial T=0$ of the output voltage $V_{OL}$ (about 0.3V calculated from the Equation (11) can be achieved by having the resistance ratio between the resistors R1 and R2 set as the Equation (15).

Figure 6:
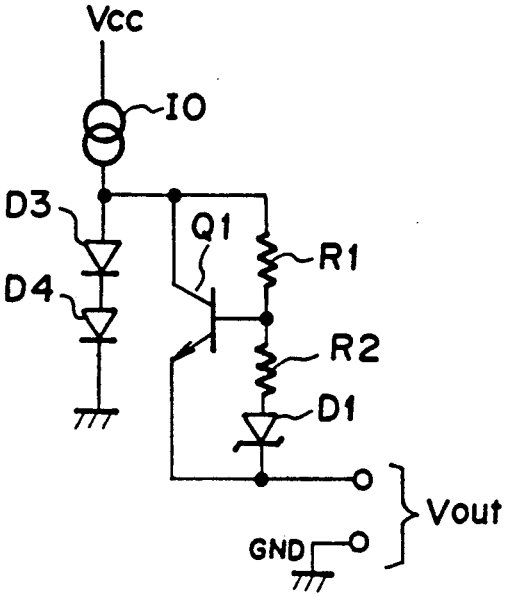
FIG. 6 shows a voltage generating circuit according to another embodiment of the present invention.

FIG. 6 shows a voltage generating circuit of another embodiment of the present invention.

In FIG. 6, there is shown an example in which the voltage generating circuit embodying the present invention is applied as a temperature-compensated reference voltage source. The present circuit is a modification of the FIG. 5 circuit in which it is made simpler by the substitution of PN junction diodes D3 and D4 for the PN junction diode D2 and the resistor R3 shown in FIG. 5. For the output voltage Vout of the voltage generating circuit, the same equation as the above Equation (11) which gives the output voltage $V_{OL}$ in respect of the preceding embodiment is applicable. The FIG. 3 circuit is advantageous in that, in addition to the advantage that the output voltage Vout is stable against the temperature variations, the circuit is capable of generating a low voltage which is difficult to obtain in a normal power supply circuit having an output voltage in the order of several hundreds mV, for example in a so-called "band gap voltage source" (the output voltage being equal to the band gap voltage $V_G$) and that, since the output is in the form of an emitter follower output of the transistor Q1, load current dependency of the output voltage is made small.

In relation to both the voltage generating circuits of the embodiments described with reference to FIGS. 5 and 6, it is to be noted that, as is clear from the Equation (13), the temperature dependency of the base-emitter forward voltage $V_F$ of the transistor Q1 is offset by the temperature dependency of the forward voltage $V_S$ of the Schottky barrier diode D1 by the resistance ratio between the resistors R1, R2, resulting in the output voltage $V_{OL}$ (FIG. 5) and the output voltage Vout (FIG. 6) being free from temperature dependency or variation.

In the explanation of each of the above embodiments, bipolar transistors have been described as being NPN type transistors. However, of course, such bipolar transistors may well be PNP type transistors as the latter produce the same effect.

As explained above, in the voltage generating circuits of the present invention, it is by the utilization of the temperature dependency difference produced between the base-emitter forward voltage $V_F$ of the bipolar transistor and the forward voltage $V_S$ of the Schottky barrier diode SBD that the temperature compensated voltage can be obtained with a simple circuit configuration and the collector saturation in the output transistor can be effectively suppressed.

While the invention has been described in its preferred embodiments, it is to be understood that the words which have been used are words of description rather than limitation and that the changes within the purview of the appended claims may be without departing from the true scope and spirits of the invention its broader aspect.

What is claimed is:

1. In combination of a voltage generating circuit with an output stage of a logical circuit including a bipolar transistor having its base connected to a voltage divider and its collector connected to an output terminal of the output stage, said voltage generating circuit comprising another bipolar transistor, a first resistor connected between the collector and the base of said another bipolar transistor and a series circuit composed of a second resistor and a Schottky barrier diode and connected between the base and the emitter of said another bipolar transistor, one end terminal of said divider circuit and the collector of said another circuit being coupled to a current source, and the emitter of said another bipolar transistor being coupled to said output terminal.

2. A voltage output circuit comprising:

a first bipolar transistor;

a second bipolar transistor having its collector connected to the emitter of said first bipolar transistor and an output node of said output circuit and its emitter grounded;

a PN junction diode coupled at its one end to a current source together with the collector of said first bipolar transistor;

a first resistor connected between the collector and the base of said first bipolar transistor, and a second resistor and a Schottky barrier diode serially connected between the base and the emitter of said first bipolar transistor; and a third resistor connected at its one end to the other end of said PN junction diode and the base of said second bipolar transistor, and at its the other end grounded.

3. A voltage output circuit comprising:

first and second voltage supply terminals;

a bipolar transistor having its collector connected to said first voltage supply terminal through a current source;

a first resistor connected between the collector and the base of said bipolar transistor;

a series circuit including a second resistor and a Schottky barrier diode and coupled between the base and the emitter of said bipolar transistor; a plurality of series-connected PN junction diodes whose one end is connected to said current source and the other end is to said second voltage supply terminal; and output voltage terminals of the output circuit, one of which is connected to the emitter of said bipolar transistor and the other is connected to said second voltage supply terminal.

4. A voltage output circuit according to claim 3, wherein an output voltage appearing across said output terminals is determined based on a band gap voltage of said bipolar transistor.

* * * * *